US005316537A

United States Patent [19]

Vaccari et al.

[11] Patent Number: 5,316,537

[45] Date of Patent: May 31, 1994

[54] METHOD AND DEVICE FOR BENDING THE END TABS OF BLANKS FOR PRODUCING RIGID FLIP-TOP CIGARETTE PACKETS

[75] Inventors: Giorgio Vaccari; Antonio Gamberini, both of Bologna, Italy

[73] Assignee: G. D Societa' Per Azioni, Bologna, Italy

[21] Appl. No.: 836,104

[22] Filed: Feb. 14, 1992

[30] Foreign Application Priority Data

Feb. 26, 1991 [IT] Italy ..... B091A 000048

[51] Int. Cl.[5] ..... B31B 3/36

[52] U.S. Cl. ..... 493/179; 493/183

[58] Field of Search ..... 493/178, 179, 183, 438, 493/447, 453, 910, 911

[56] References Cited

U.S. PATENT DOCUMENTS

| | | | |
|---|---|---|---|
| 1,444,348 | 2/1923 | La Bombard et al. | 493/179 |
| 2,986,078 | 5/1961 | Hottendorf | 493/179 |
| 3,807,289 | 4/1974 | Labombarde | 493/178 |
| 4,392,338 | 7/1983 | Fox | 493/911 |
| 5,029,834 | 7/1991 | Boldrini et al. | 271/11 |
| 5,052,993 | 10/1991 | Focke | 493/178 |
| 5,113,638 | 5/1992 | Focke et al. | 493/911 |

*Primary Examiner*—William E. Terrell

*Attorney, Agent, or Firm*—Marshall, O'Toole, Gerstein, Murray & Borun

[57] ABSTRACT

A method and device for bending the end tabs of blanks for producing rigid flip-top cigarette packets. The blanks are loaded on a conveyor and are fed continuously along a path with the end tabs slidably engaged in a helical slit, which is in part defined by facing helical surfaces of first and second helical guide elements. The blanks wind over an arc of 180° for bending the end tabs in a U and enabling the bent end tabs to be fed between two pressure rollers of a stabilizing unit.

8 Claims, 2 Drawing Sheets

METHOD AND DEVICE FOR BENDING THE END TABS OF BLANKS FOR PRODUCING RIGID FLIP-TOP CIGARETTE PACKETS

BACKGROUND OF THE INVENTION

The present invention relates to a method of bending the end tabs of blanks for producing rigid flip-top cigarette packets.

Rigid flip-top cigarette packets are produced from substantially elongated rectangular blanks, each comprising an end tab with a transverse bend line. On the end tab, the bend line defines an inner portion constituting the front wall of the flip-top lid of the packet; and an outer portion constituting a stiffening tab for the front wall, when bent in a U about the bend line and on to the inner surface of the front wall.

On known packing machines, the stiffening tab is normally bent in a U as described above by means of devices comprising a conveyor, on to which the blanks are fed successively, with the end tab projecting from the lateral edge of the conveyor, and fed in steps transversely, i.e. in a direction parallel to the bend line, through a fixed bending station, where they are arrested for bending the stiffening tab by means of a movable bending member.

Known methods of the type described above present several drawbacks, all of which are mainly caused by using a step conveyor. To avoid penalizing the output capacity of the packing machine, the step conveyor must be arrested for as short a time as possible, which means maximizing the speed of the operations performed on the packets and/or blanks between successive steps of the conveyor. Clearly, however, in the case of bending a tab in a U by means of a movable bending member, such high speed operation invariably involves the risk of puncturing or tearing the tab.

To overcome the above drawback, highly complex bending members have been devised for minimizing impact between the tab and the bending member. These, however, are extremely expensive and of such complex mechanical design as to be invariably unreliable.

SUMMARY OF THE INVENTION

It is an object of the present invention to provide a method of bending the end tabs of blanks, designed to overcome the aforementioned drawbacks.

According to the present invention, there is provided a method of bending the end tabs of blanks for producing rigid flip-top cigarette packets, each said end tab constituting an end portion of said blank and having an intermediate transverse bend line defining, on said end tab, an inner portion and an outer portion constituting a stiffening tab; said method comprising stages consisting in successively feeding the blanks on to a conveyor, with the respective end tabs of the blanks projecting from a lateral edge of the conveyor; and bending the stiffening tab of each blank in a U about said bend line, as the blank is fed by the conveyor along a given bending path and in a direction parallel to said bend line; characterized by the fact that the blanks are fed continuously by the conveyor along said path; each blank cooperating, along a portion of said path, with a first lateral surface of a first profile internally supporting the inner portion of the end tab, and with a second profile, the surface of which facing said end tab consists of a first strip externally cooperating with the inner portion of the end tab, and a second strip extending along the first strip and cooperating externally with the stiffening tab; the second strip being helical in shape, and winding over an arc of 180° in relation to the first strip, for bending the end tab in a U; and the end tab, thus bent, being stabilized by means of drawing.

The present invention also relates to a bending device implementing the above method.

According to the present invention, there is provided a device for bending the end tabs of blanks for producing rigid flip-top cigarette packets, each said end tab constituting an end portion of said blank and having an intermediate transverse bend line defining, on said end tab, an inner portion and an outer portion constituting a stiffening tab; said device comprising a conveyor for supporting a succession of blanks with the respective end tabs projecting outwards of a lateral edge of the conveyor; and means for bending the end tab of each said blank in a U about said bend line, as the blank is fed by the conveyor along a given bending path and in a direction parallel to said bend line; characterized by the fact that said conveyor is a continuous feed conveyor; and that said bending means comprise a first profile extending along a portion of said bending path and having a first lateral surface internally supporting the inner portion of the end tab, and a second profile having a lateral surface cooperating with the end tab and comprising a first strip cooperating externally with the inner portion of the end tab, and a second strip extending along the first strip and cooperating externally with the stiffening tab; the second strip being helical in shape, and winding over an arc of 180° in relation to the first strip, for bending the end tab in a U; and drawing means being provided for stabilizing the bent end tab.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
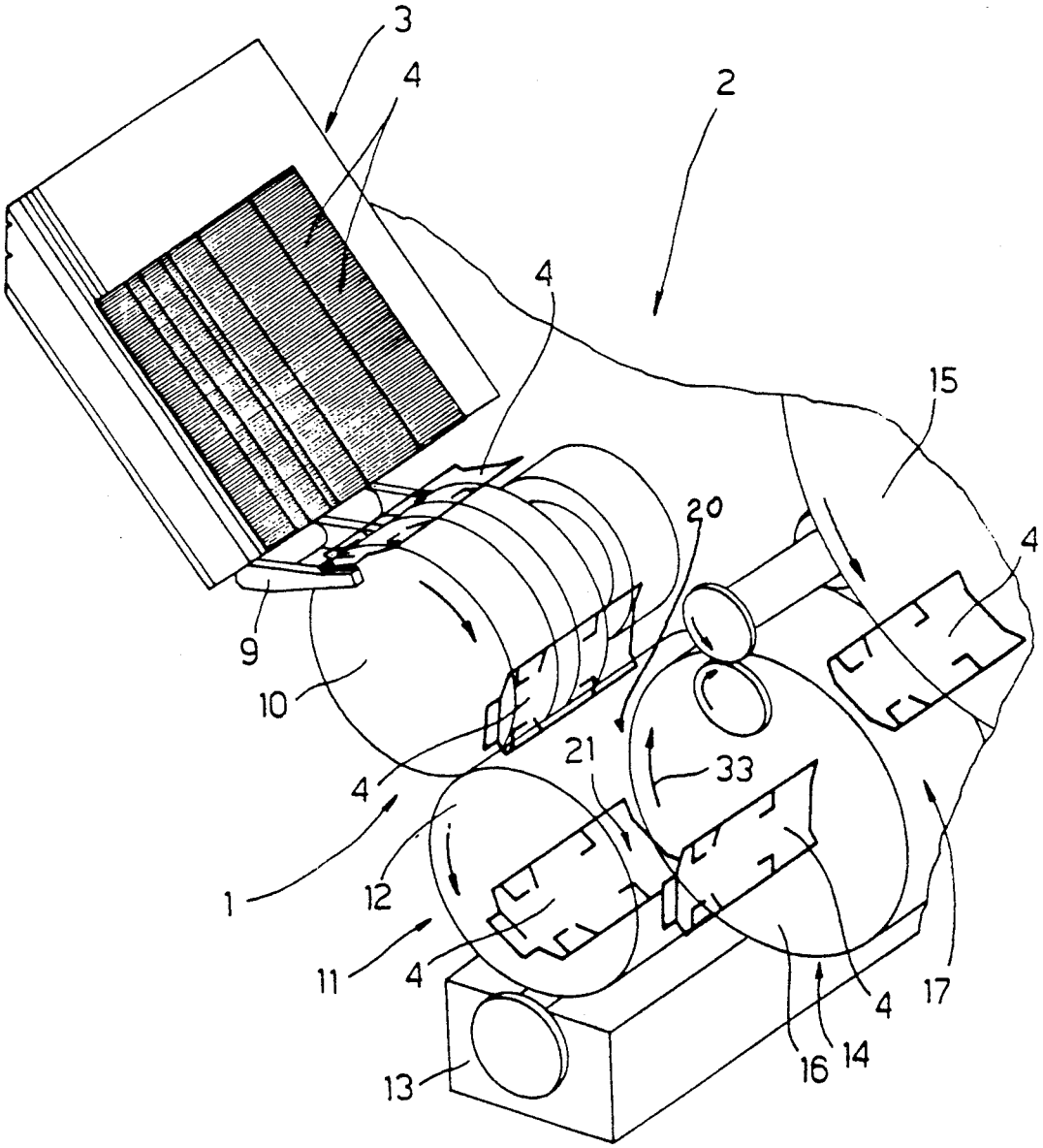
FIG. 1 shows a schematic view in perspective of the input unit of a cigarette packing machine comprising a preferred embodiment of a bending device in accordance with the present invention.

Number 1 in FIG. 1 indicates the input unit of a cigarette packing machine 2 comprising a substantially vertical feedbox 3 containing a stack of blanks 4 arranged with the printed surface (hereinafter referred to as the "outer surface") facing upwards, and the non-printed surface (hereinafter referred to as the "inner surface") facing the bottom opening of feedbox 3. As shown, particularly in FIG. 2, each blank 4 is substantially rectangular, and comprises an end tab 5 with an intermediate transverse bend line 6 defining, on end tab 5, an inner portion 7 and an outer portion constituting a stiffening tab 8.

Unit 1 also comprises a known extracting device 9 for successively engaging and withdrawing blanks 4 through the bottom opening of feedbox 3, and feeding them, with the inner surface downwards, on to a first conveyor roller 10 rotating continuously clockwise in FIG. 1, and on which blanks 4 are retained by a known suction system (not shown). Extracting device 9 is as described in Italian Patent Application N. 3318A/89 filed by the present Applicant, and to which full reference is made herein in the interest of full disclosure. U.S. Pat. No. 5,029,834 issued Jul. 9, 1991 is based on that Italian application.

Unit 1 also comprises a gumming unit 11 consisting, in known manner,, of a further conveyor roller 12 tangent to roller 10 and rotating continuously anticlockwise in FIG. 1 for successively receiving blanks 4 off roller 10 and feeding them, with the inner surface outwards, on to a gumming device 13, e.g. of the type described and claimed in Italian Patent Application N. 3668A/90 filed by the present Applicant, and to which full reference is made herein in the interest of full disclosure. U.S. Pat. application Ser. No. 07/769,846 filed Oct. 2, 1991 is based on that Italian application. Gumming device 13 provides for applying gum to specific inner surface portions of blanks 4 and, in particular, to the inner surface of stiffening tab 8.

Unit 1 also comprises a bending device 14 between roller 12 and a known wrapping wheel 15, for bending end tab 5 in a U along bend line 6, and gumming the inner surface of stiffening tab 8 on to the inner surface of inner portion 7 of end tab 5.

Device 14 comprises a roller 16 rotating continuously clockwise in FIG. 1, and having a cylindrical outer surface 17 tangent to both roller 12 and wrapping wheel 15. Blanks 4 are fed from roller 12 to roller 16 with the inner surface contacting cylindrical surface 17, and with end tab 5 projecting outwards of circular edge 18 defined by cylindrical surface 17 and the end surface 19 of roller 16. Roller 16 feeds blanks 4 continuously and at substantially constant speed along a bending arc 20 extending from the point of tangency 21 of rollers 12 and 16, and along which end tabs 5 are bent in a U.

Figure 2:
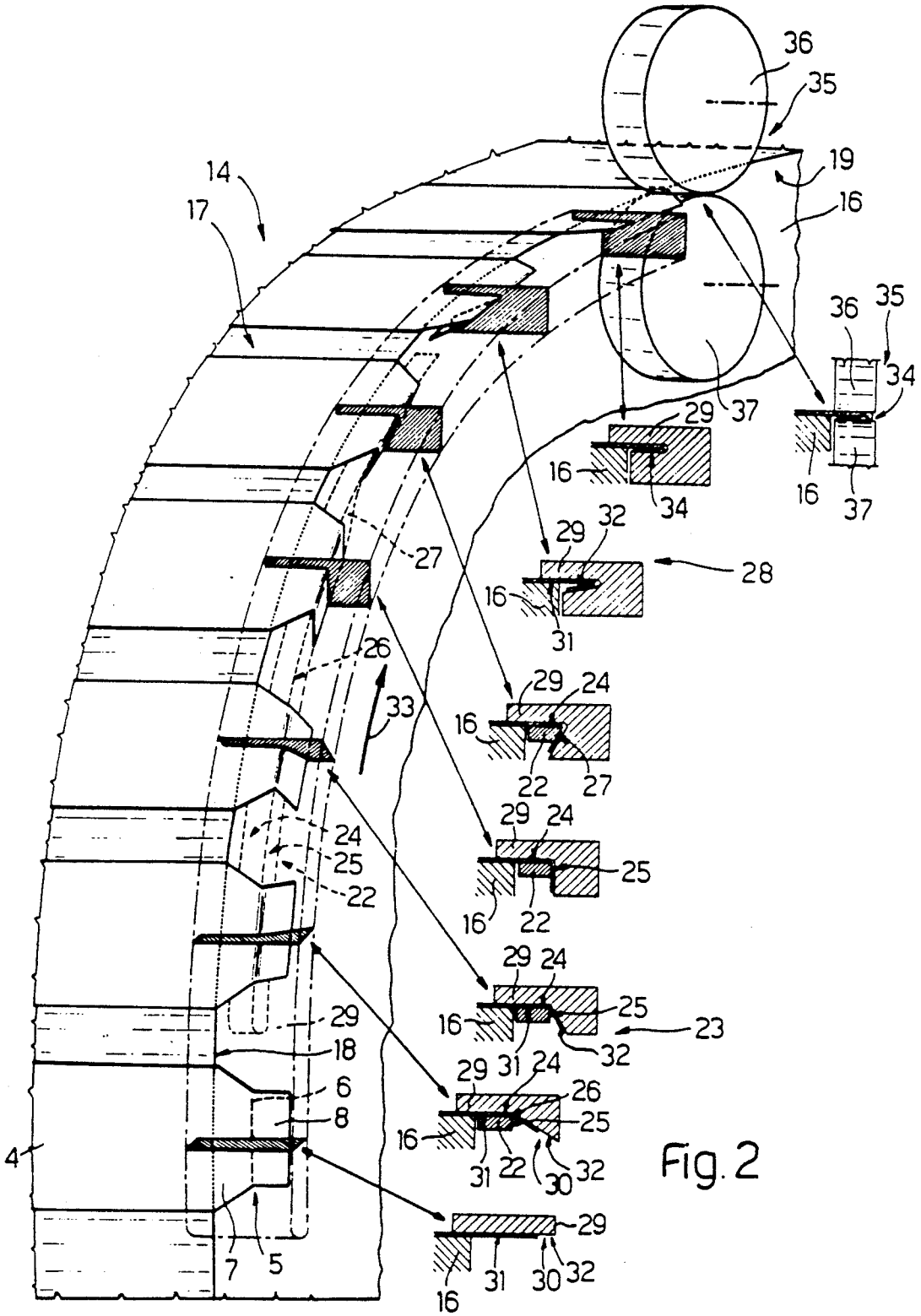
FIG. 2 shows a schematic partially-sectioned view in perspective, with parts removed for simplicity, of the operation of a detail in FIG. 1.

Device 14 also comprises a first profile or guide element 22 facing surface 19 and extending substantially along edge 18 and at least initially along the input portion 23 of bending arc 20. Profile 22 presents a substantially cylindrical outer lateral surface 24 coaxial and coplanar with cylindrical surface 17, for internally supporting inner portion 7 of end tab 5; and a lateral end surface 25 facing away from surface 19 and connected to surface 24 along a circular edge 26 located beneath and defining the path of bend line 6. As shown in FIG. 2, surface 25 is initially perpendicular to surface 24, and presents an end or output portion 27 extending along an initial portion of output portion 28 of arc 20, and which is helical in shape so as to form an increasingly smaller angle with surface 24.

Device 14 also comprises a second profile or guide element 29 outwards of profile 22, substantially facing surface 19, and extending along arc 20 and edge 18.

On the side facing profile 22, profile 29 presents a lateral surface 30 cooperating with the outer surface of end tab 5, and comprising a first cylindrical strip or longitudinal portion 31 cooperating externally with inner portion 7 of end tab 5, and a second strip or longitudinal portion 32 extending along first strip 31 and cooperating externally with stiffening tab 8. Strip 32 is helical in shape, extends along substantially the whole of arc 20, and winds a total of 180° in relation to strip 31, for bending end tab 5 in a U with stiffening tab 8 beneath inner portion 7 of end tab 5. As shown in FIG. 2, strip 32 is coplanar with strip 31 at the start of input portion 23 of arc 20. As it proceeds along arc 20 in the rotation direction of roller 16 indicated by arrow 33, strip 32 winds clockwise (in FIG. 2) about the connection point with strip 31 until, at the end of input portion 23 of arc 20, it is perpendicular to strip 31.

In other words, between the start and end of input portion 23 of arc 20, the angle between strip 32 and lateral surface 25 of profile 22 is gradually reduced from an initial value of substantially 90° to 0°, at which point, strip 32 is located outwards of profile 22, facing and parallel to surface 25, and at a distance from surface 25 slightly greater than the thickness of blanks 4.

At the start of output portion 28 of arc 20, the angle between strips 31 and 32 is less than 90°, and strip 32 continues winding parallel to output portion 27 of surface 25. Downstream from the end of profile 22, strip 32 continues winding until, at the end of output portion 28 of arc 20, it is located inside, parallel to and facing strip 31.

Consequently, as shown in FIG. 2, which illustrates various stages in the bending of end tab 5 of blank 4, at the start of arc 20, end tab 5 of blank 4 on roller 16 is engaged between profiles 22 and 29; inner portion 7 is maintained flat on surface 24 of profile 22 and engaged, at least along input portion 23 of arc 20, between surface 24 of profile 22 and strip 31 of surface 30 of profile 29; and stiffening tab 8 is gradually bent by helical strip 32 underneath inner portion 7 and about bend line 6, which is maintained on edge 26 for as long as blank 4 travels along input portion 23 of arc 20. When the angle between inner portion 7 and stiffening tab 8 is slightly less than 90°, profile 22 may be dispensed with in that, at this point, the thrust exerted by strip 32 on stiffening tab 8 is directed outwards towards strip 31, which alone is sufficient for maintaining inner portion 7 flat.

As shown more clearly in FIG. 2, at the end of arc 20, stiffening tab 8 is stabilized and gummed in position contacting the inner surface of inner portion 7 by drawing pack 34, consisting of inner portion 7 and stiffening tab 8 arranged facing and parallel to each other, through a stabilizing unit 35 connected to roller 16 in a manner not shown. Stabilizing unit 35 is maintained in a fixed position at the end of arc 20 and along the path of packs 34, and comprises at least two idle rollers 36 and 37 tangent to each other and to the path of packs 34.

We claim:

1. A method of bending the end tabs (5) of blanks (4) for producing rigid flip-top cigarette packets, each end tab (5) constituting an end portion of a respective blank (5) and having an intermediate transverse bend line (6) defining, on the end tab (5), an inner portion (7) and an outer portion constituting a stiffening tab (8);

said method comprising the steps of successively feeding the blanks (4) onto a conveyor (16), with the respective end tabs (5) projecting from a lateral edge (18) of the conveyor (16);

feeding each blank (4) continuously by the conveyor (16) along a given bending path (20) and in a direction (33) parallel to said bend line (6);

and bending the stiffening tab (8) of each blank (4) in a U about said bend line (6) as the blank (4) is fed by the conveyor (16) along the bending path (20);

each blank (4) being made to cooperate, along a portion of the bending path (20), with a first lateral surface (24) of a first guide element (22) internally supporting the inner portion (7) of the end tab (5), and with a second guide element (29) having a surface (30) facing said end tab (5) which comprises a first longitudinal portion (31) externally cooperating with the inner portion (7) of the end tab (5), and a second longitudinal portion (32) cooperating externally with the stiffening tab (8);

the second longitudinal portion (32) being helical in shape, and winding over an arc of 180° in relation to the first longitudinal portion (31), for bending the end tab (5) in a U;

each end tab (5), thus bent, being stabilized by means of pressing;

each end tab (5) being made to travel, as it advances along an output portion (28) of the bending path (20), with its stiffening tab (8) in contact with a second lateral surface (27) of said first guide element (22);

the second lateral surface (27) being helical in shape, and substantially parallel to and facing the second longitudinal portion (32).

2. A method as claimed in claim 1 wherein said pressing for stabilizing the bent end tab (5) comprises feeding each bent end tab (5) between opposed pressure rollers (36, 37) of a stabilizing unit (35).

3. A method as claimed in claim 1 wherein the bend line (6) of each end tab (5), as the end tab (5) travels along said output portion (28) of said path (20), is made to advance along a path defined by an edge (26) of connection of the second lateral surface (27) to the first lateral surface (25).

4. A device (14) for bending the end tabs (5) of blanks (4) for producing rigid flip-top cigarette packets, each end tab (5) constituting an end portion of a respective blank (4) and having an intermediate transverse bend line (6) defining, on the end tab (5), an inner portion (7) and an outer portion constituting a stiffening tab (8);

said device (14) comprising a continuous feed conveyor (16) for supporting a succession of blanks (4) with the respective end tabs (5) projecting outwardly of a lateral edge (18) of the conveyor (16), and for advancing each blank (4) along a given bending path (20) in a direction (33) parallel to the relevant bend line (6);

means for bending the end tab (5) of each blank (4) in a U about said bend line (6), as the blank (4) is fed by the conveyor (16) along the bending path (20);

said bending means comprising a first guide element (22) extending along a portion of the bending path (20) and having a first lateral surface 924) internally supporting the inner portion (7) of the end tabs (5), and a second guide element (29) having a lateral surface (30) cooperating with the end tabs (5) and comprising a first longitudinal portion (31) cooperating externally with the inner portion of the end tabs (5), and a second longitudinal portion (32) extending along the first longitudinal portion (31) and cooperating externally with the stiffening tabs (8);

the second longitudinal portion (32) being helical in shape, and winding over an arc of 180° in relation to the first longitudinal portion (31), for bending the end tabs (5) in a U;

the first guide element (22) having a second lateral helical surface (27) extending along the output portion (28) of the bending path (20), and arranged facing output portion (28) of the bending path (20), and arranged facing and substantially parallel to the second longitudinal portion (32);

and pressing means (35) for stabilizing the bent end tabs (5).

5. A device as claimed in claim 4 wherein the pressing means (35) comprise at least two opposed pressure rollers (36, 37).

6. A device as claimed in claim 4 wherein the second lateral surface (27) is connected to the first lateral surface (24) along an edge (26) defining an advancement path of each bend line (6).

7. A device as claimed in claim 4 wherein the conveyor (16) comprises a roller having a cylindrical outer surface (17) provided with a circular edge (18);

the end tabs (5) project outwardly of said circular edge (18);

the bending path (20) is circular;

and the first and second guide elements (22, 29) extend along the bending path (20).

8. A device as claimed in claim 7 wherein the first lateral surface (24) and the first longitudinal portion (31) are coaxial cylindrical surfaces, the first located inside the second.

* * * * *